United States Patent [19]

Van der Auweraer et al.

[11] Patent Number: 4,923,774

[45] Date of Patent: May 8, 1990

[54] LAYERED ELECTROPHOTOGRAPHIC RECORDING ELEMENT COMPRISING P-TYPE CHARGE TRANSPORT COMPOUNDS

[75] Inventors: Mark G. Van der Auweraer; Frans C. De Schrijver; Guy P. Verbeek; Carina Geelen, all of Leuven; David R. Terrell, Lint; Stefaan K. De Meutter, Zandhoven, all of Belgium

[73] Assignee: Agfa-Gevaert, N.V., Mortsel, Belgium

[21] Appl. No.: 367,125

[22] Filed: Jun. 16, 1989

[30] Foreign Application Priority Data

Jun. 28, 1988 [EP] European Pat. Off. ..... 88201332.9

[51] Int. Cl.[5] ..... G03G 5/14

[52] U.S. Cl. ..... 430/59; 252/500

[58] Field of Search ..... 430/58, 59; 252/500

[56] References Cited

U.S. PATENT DOCUMENTS 4,140,529 2/1979 Pai et al. ..... 430/59

4,304,829 12/1981 Limburg et al. ..... 430/59

4,330,608 5/1982 Limburg et al. ..... 430/59

*Primary Examiner*—J. David Welsh

*Attorney, Agent, or Firm*—A. W. Breiner

[57] ABSTRACT

An electrophotographic recording material comprising a conductive support and a photosensitive layer containing a photoconductive compound that has p-type charge transport capacity and corresponds to the following general formula (I):

(I)

wherein:

$R^1$ represents a $—NR^3R^4$ group, wherein each of $R^3$ and $R^4$ (same or different) represents a $C_1$–$C_{10}$ alkyl group including said alkyl group in substituted form, a cycloalkyl group, or an aryl group, and $R^2$ represents hydrogen, an alkyl group including a substituted alkyl group or halogen.

11 Claims, No Drawings

LAYERED ELECTROPHOTOGRAPHIC RECORDING ELEMENT COMPRISING P-TYPE CHARGE TRANSPORT COMPOUNDS

DESCRIPTION

The present invention relates to a photosensitive recording material suited for use in electrophotography.

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material, the photoconductive recording material is reusable. In order to permit a rapid multiple printing or copying a photoconductor layer has to be used that rapidly looses its charge on photo-exposure and also rapidly regains its insulating state after exposure to receive again a sufficiently high electrostatic charge for a next image formation. The failure of a material to return completely to its relatively insulating state prior to succeeding charging-/imaging steps is commonly known in the art as "fatigue".

The fatigue phenomenon has been used as a guide in the selection of commerically useful photoconductive materials, since the fatigue of the photoconductive layer limits the copying rate achievable.

Another important property which determines whether or not a particular photoconductive material is suited for electrophotographic copying is its photosensitivity that must be high enough for use in copying apparatus operating with a copying light source of fairly low intensity.

Commercial usefulness further requires that the photoconductive layer has a chromatic sensitivity that matches the light source. In the case of a white light source, it should have panchromatic sensitivity and allow the reproduction of all colours in balance.

Intensive efforts have been made to satisfy said requirements, e.g. the spectral sensitivity of selenium has been extended to the longer wavelengths of the visible spectrum by making alloys of selenium, tellurium and arsenic. In fact selenium-based photoconductors remained for a long time the only really useful photoconductors although a lot of organic photoconductors were discovered.

Organic photoconductor layers of which poly(N-vinylcarbazole) layers have been the most useful were less interesting because of lack of speed, insufficient spectral sensitivity and rather large fatigue.

However, the discovery that 2,4,7-trinitro-9-fluorenone (TNF) in poly(N-vinylcarbazole) (PVCz) formed a charge-transfer complex strongly improving the photosensitivity (ref. U.S. Pat. No. 3,484,237) has opened the way for the use of organic photoconductors in copying machines that could compete with the selenium-based machines.

TNF acts as an electron acceptor whereas PVCz serves as electron donor. Films consisting of said charge transfer complex with a 1:1 molar ratio of TNF:PVCz are dark brown, nearly black and exhibit high charge acceptance and low dark decay rates. Overall photosensitivity is comparable to that of amorphous selenium (ref. Schaffert, R.M. IBM J. Res. Develop., 15, 75 (1971).

A further search led to the discovery of phthalocyanine-binder layers, using poly(N-vinylcarbazole) as the binder [ref. Hackett, C.F., J. Chem. Phys., 55, 3178 (1971)]. The phthalocyanine was used in the metal-free X form and according to one embodiment applied in a multilayer structure wherein a thin layer of said phthalocyanine was overcoated with a PVCz layer. Hackett found that photoconductivity was due to field dependent photogeneration of electron-hole pairs in the phthalocyanine and hole injection into the PVCz. The transport of the hole carriers, i.e. positive hole conduction proceeded easily in the PVCz layer. From that time on much research has been devoted to developing improved photoconductive systems wherein charge generation and charge transport materials are separate in two contiguous layers (see e.g. U.K. Pat. No. 1,577,859). The charge generating layer may be applied underneath or on top of the charge transport layer. For practical reasons, less sensitivity to wear and ease of manufacture, the first mentioned arrangement is preferred wherein the charge generating layer is sandwiched between a conductive support and a light transparent charge transport layer (ref. Wolfgang Wiedemann, Organische Photoleiter-Ein Uberblick, II, Chemiker Zeitung, 106. (1982) Nr. 9 p. 315).

In order to form a photoconductive two layer-system with high photosensitivity to the incident light dyes having the property of photo-induced charge generation have been selected. Preference is given to a pigment dye of e.g. one of the following classes:

(a) perylimides, e.g. C.I. 71 130 (C.I.=Colour Index) described in DBP 2 237 539, (b) polynuclear quinones, e.g. anthanthrones such as C.I. 59 300 described in DBP 2 237 678, (c) quinacridones, e.g. C.I. 46 500 described in DBP 2 237 679, (d) naphthalene 1,4,5,8-tetracarboxylic acid derived pigments including the perinones, e.g. Orange GR, C.I. 71 105 described in DBP 2 239 923, (e) phthalocyanines, e.g. $H_2$-phthalocyanine in X-crystal form (X-$H_2$Ph), metal phthalocyanines, e.g. CuPc C.I. 74 160 described in DBP 2 239 924 and indium phthalocyanine described in U.S. Pat. No. 4,713,312, (f) indigo- and thioindigo dyes, e.g. Pigment Red 88, C.I. 73 312 described in DBP 2 237 680, (g) benzothioxanthene-derivatives as described e.g. in DAS 2 355 075, (h) perylene 3,4,9,10-tetrcarboxylic acid derived pigments including condensation products with o-diamines as described e.g. in DAS 2 314 051, (i) polyazo-pigments including bisazo-, trisazo- and tetrakisazo-pigments, e.g. Chlordiane Blue C.I. 21 180 described in DAS 2 635 887, and bisazopigments described in DOS 2 919 791, DOS 3 026 653 and DOS 3 032 117, (j) squarilium dyes as described e.g. in DAS 2 401 220, (k) polymethine dyes.

(l) dyes containing quinazoline groups, e.g. as described in GB-P 1 416 602 according to the following general formula:

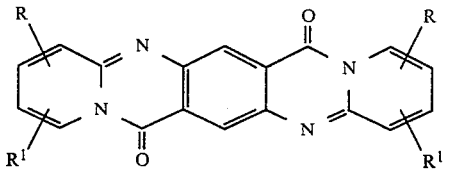

in which R and $R^1$ are either identical or different and denote hydrogen, $C_1$–$C_4$ alkyl, alkoxy, halogen, nitro or hydroxyl or together denote a fused aromatic ring system, (m) triarylmethane dyes, and (n) dyes containing 1,5 diamino-anthraquinone groups.

The charge transporting layer can comprise either a polymeric material or a nonpolymeric material. In the case of nonpolymeric materials the use of such materials with a polymeric binder is generally preferred or required for sufficient mechanical firmness and flexibility. This binder may be "electronically inert" (that is incapable of substantial transport of at least one species of charge carrier) or can be "electronically active" (capable of transport of that species of charge carriers that are neutralized by a uniformly applied electrostatic charge). In the arrangements: conductive support-charge generating layer-charge transport layer and conductive support-charge transport layer-charge generating layer, the polarity of electrostatic charging that gives the highest photosensitivity to the arrangement has to be such that negative charging is applied to a hole conducting (p-type) charge transport layer and positive charging is applied to an electron conducting (n-type) charge transport layer.

Since most of the organic pigment dyes of the charge generating layer provide more efficient hole injection than electron injection across a field-lowered barrier at the interface where pigment-dye/charge transport compound touch each other and possibly form a charge transfer complex there is a need for charge transport materials that have a good hole transport capacity for providing an electrophotographic recording system with low fatigue and high photosensitivity.

According to the already mentioned article "Organische Photoleiter-Ein Uberblick; II of Wolfgang Wiedemann, p. 321, particularly efficient p-type transport compounds can be found in the group consisting of heteroaromatic compounds, hydrazone compounds and triphenylmethane derivatives. Examples of double layer systems containing hydrazone compounds as charge transporting substance are described in U.S. Pat. No. 4,278,747 and 4,365,014. Examples of polyamino substituted triphenylmethane derivatives that are particularly useful as charge transporting compounds in a double layer photoconductive system are described given in U.S. Pat. No 4,140,529.

It is an object of the present invention to provide an electrophotographic recording material comprising a conductive substrate and a photosensitive layer containing an organic photoconductor compound that has a high p-type charge transport capacity.

It is a further object of the present invention to provide an electrophotographic composite layer material comprising on a conductive support a charge generating layer in contiguous relationship with a charge transporting layer containing an aromatic polyamino compound having high p-type charge transport capacity.

It is another object of the present invention to provide a recording process wherein a charge pattern of negative charge polarity is formed on said composite layer material by negatively charging a charge transporting layer containing a photoconductive aromatic polyamino compound and imagewise photo-exposing a charge generating layer that is in contiguous relationship with said charge transporting layer.

Other objects and advantages of the present invention will appear from the further description and examples.

In accordance with the present invention an electrophotographic recording material is provided comprising a conductive support and a photosensitive layer containing a photoconductive compound that has p-type charge capacity and corresponds to the following general formula (I):

(I)

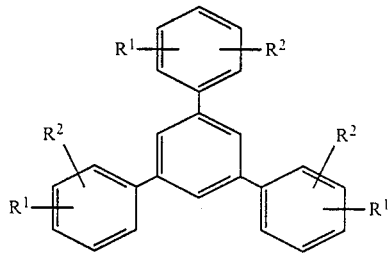

wherein:

$R^1$ represents a $—NR^3R^4$ group, wherein each of $R^3$ and $R^4$ (same or different) represents a $C_1$–$C_{10}$ alkyl group including said alkyl group in substituted form, e.g. an aralkyl group, preferably a benzyl group, or an alkoxycarbonyl substituted $C_1$–$C_{10}$ alkyl group, a cycloalkyl group, or an aryl group, and $R^2$ represents hydrogen, an alkyl group including a substituted alkyl group, e.g. methyl, alkoxycarbonyl substituted alkyl or halogen, e.g. chlorine.

According to a preferred embodiment of the present invention an electrophotographic recording material is provided which comprises an electrically conductive support having thereon a charge generating layer in contiguous relationship with a charge transporting layer, characterized in that said charge transporting layer contains a 1,3,5-tris(aminophenyl) benzene compound corresponding to the following general formula (I):

(I)

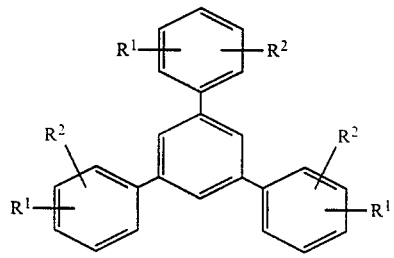

wherein: $R^1$ and $R^2$ are as defined above.

In preferred compounds for use according to the present invention each of $R^3$ and $R^4$ independently of each other in the group $—NR^3R^4$ in said general formula (I) represents methyl, ethyl, benzyl or an ethoxycarbonyl substituted alkyl group.

1,3,5-Tris(aminophenyl) benzene compounds having a melting point of at least 100° C. are preferred in order to prevent softening of the charge transport layer and diffusion of said compound out of the recording material at elevated temperatures.
Specific examples of novel compounds suited for use according to the present invention are listed in the following Table.
TABLE
1.
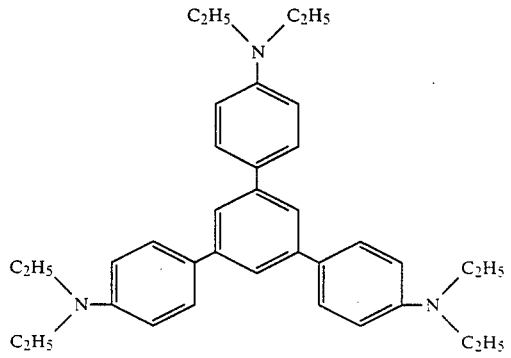
2.
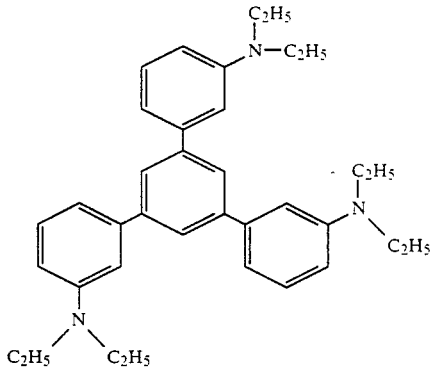
3.
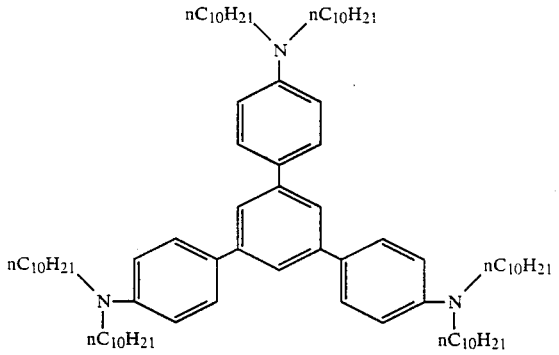
4.
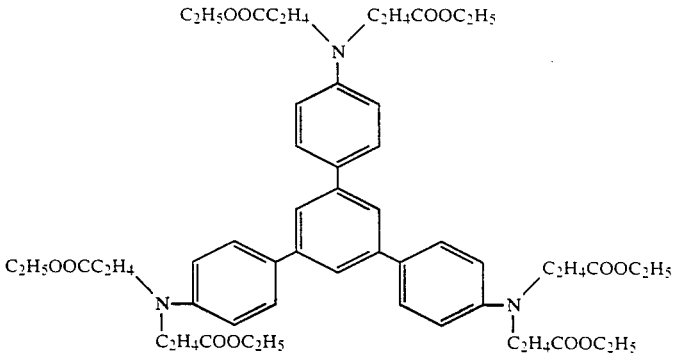

TABLE-continued
5.
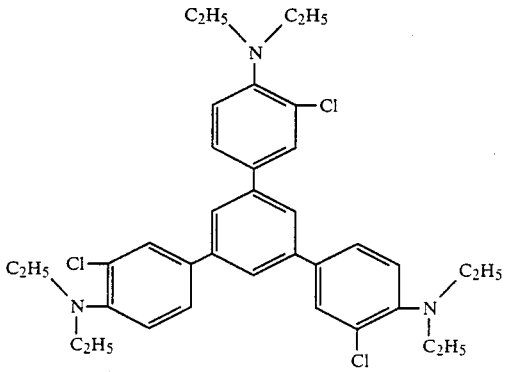
6.
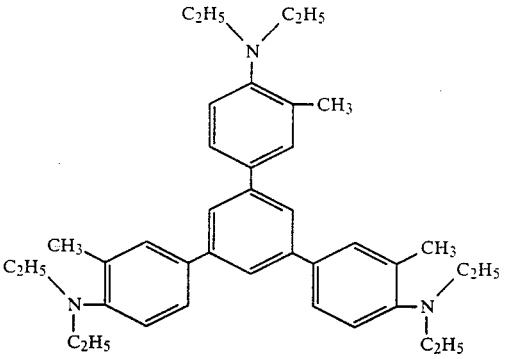
7.
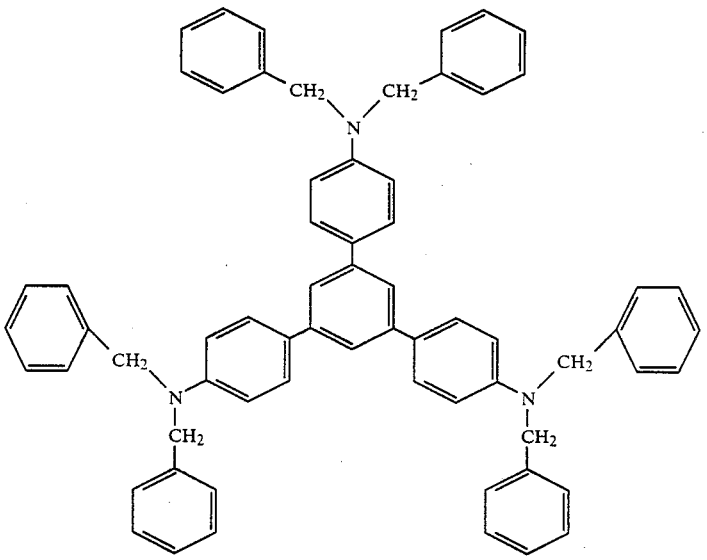

TABLE-continued
8.
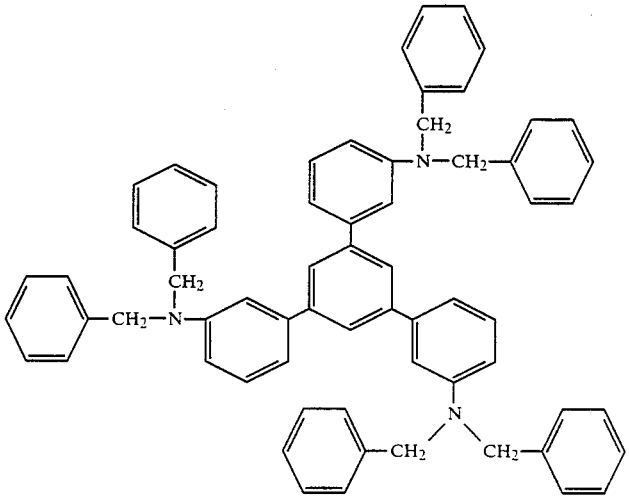
9.
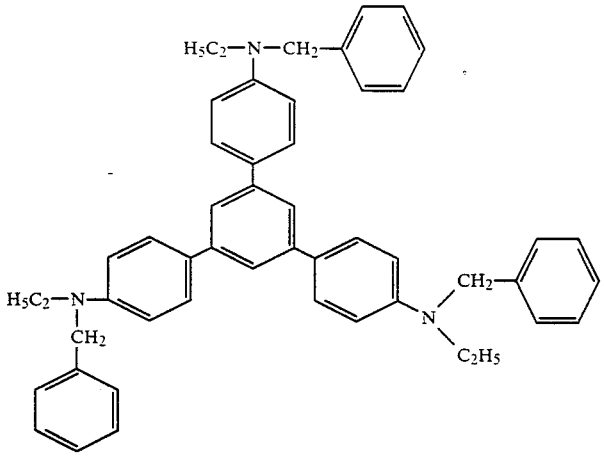
10.
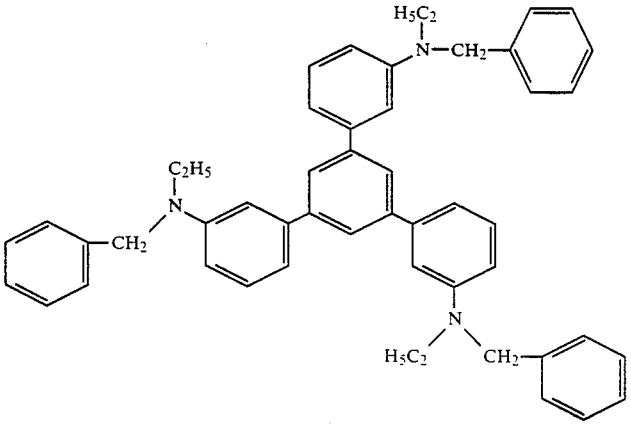

TABLE-continued
11.
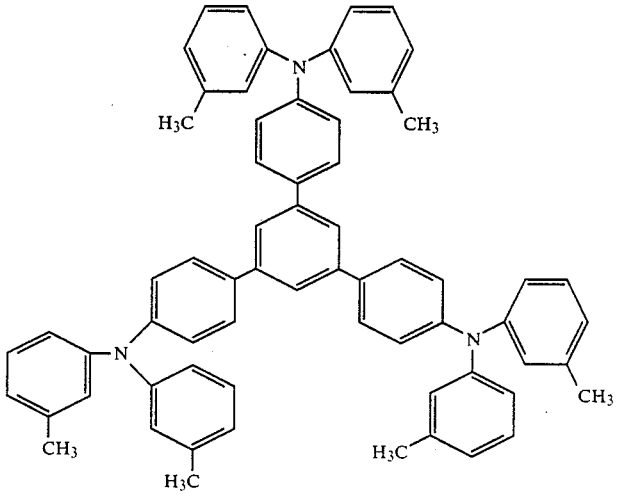
12.
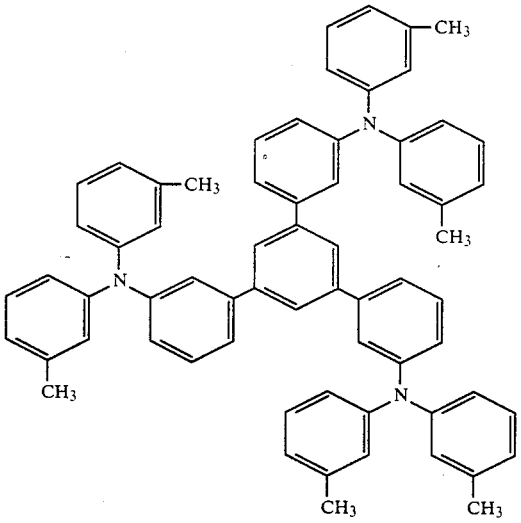
13.
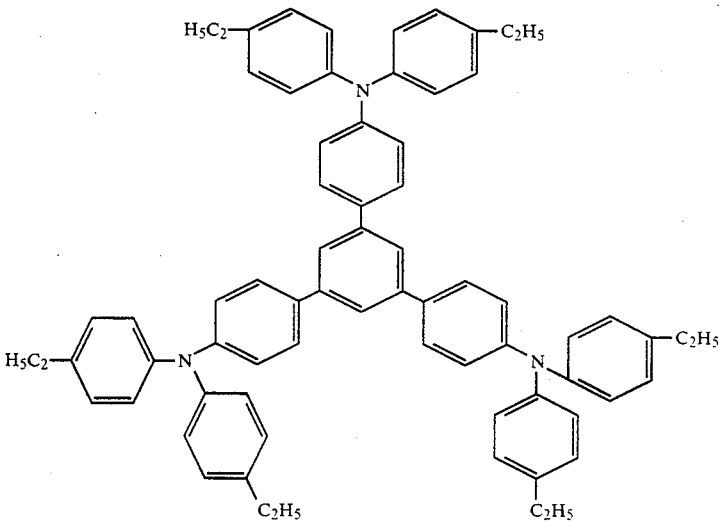

TABLE-continued

14.

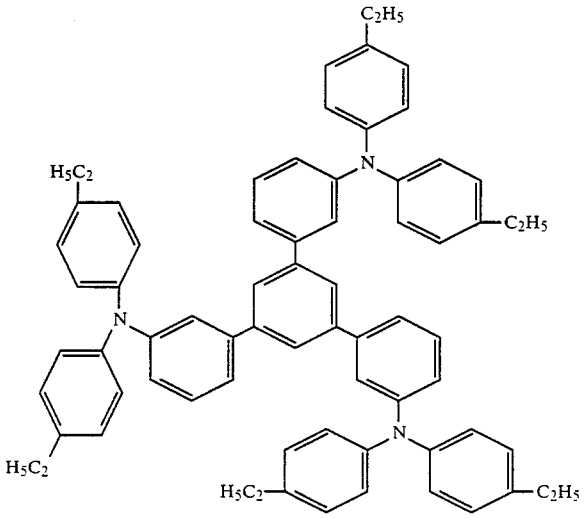

15.

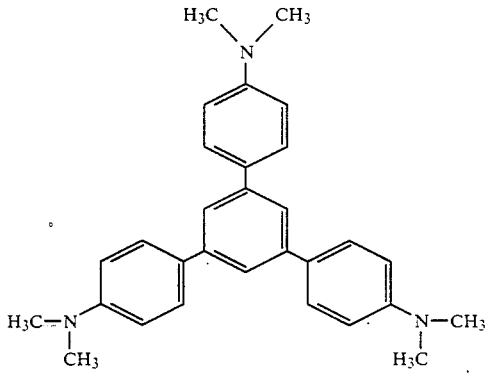

16.

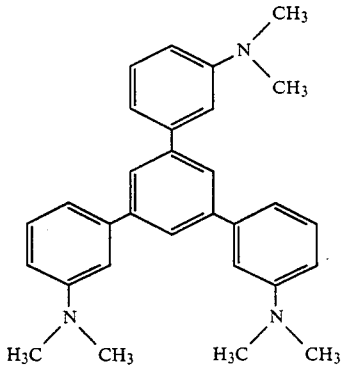

The preparation of 1,3,5-tris(aminophenyl)benzenes for use according to the present invention can proceed for example, by starting with the trimerization of appropriately substituted nitro, amino, acetylamino, bromo or chloro acetophenones with potassium pyrosulfate/sulfuric acid, hydrogen chloride or in the presence of aluminum oxide catalysts. Trimerization yields as a major product 1,3,5-tris(nitrophenyl), 1,3,5-tris(aminophenyl), 1,3,5-tris(acetylaminophenyl), 1,3,5-tris(chlorophenyl) and 1,3,5-tris(bromophenyl) benzenes respectively.

The 1,3,5-tris(nitrophenyl) benzenes and 1,3,5-tris-(acetylaminophenyl) benzenes can be converted to the corresponding 1,3,5-tris(aminophenyl) benzenes by reduction with tin/hydrochloric acid and alkaline hydrolysis respectively.

The 1,3,5-tris(chlorophenyl) and 1,3,5-tris(-bromophenyl) benzenes can be converted into 1,3,5-tris-(aminophenyl) benzenes by reaction with ammonia under pressure.

The obtained 1,3,5-tris(aminophenyl) benzenes can be converted into the substituted amino compounds for use according to the present invention by conventional techniques such as alkylation with bromoalkanes or tosylalkanes in the presence of sodium carbonate or with the ethyl ester of Beta-bromopropionic acid.

An alternate route of synthesis of 1,3,5-tris(dimethylaminophenyl) benzene applies the trimerization of p-dimethylaminoacetophenone in the presence of aniline and aniline hydrochloride under carbon dioxide atmosphere at 180° C. [see the analogous preparation of 1,3,5-triphenyl-benzene by Vorländer et al., in Berichte der Deutschen Chemischen Gesellschaft, 62, 2837, (1929)].

The following preparations illustrate in more detail the synthesis of the compounds 1, 2, 7, 9 and 11 listed in the preceding Table.

PREPARATION OF COMPOUND 1

1,3,5-tris(4-nitrophenyl) benzene was first prepared by adding 2 ml of concentrated sulphuric acid and then 45 g of freshly dried potassium pyrosulfate to 28 g of molten 4-nitroacetophenone with constant stirring and allowing the mixture to react for 8 hours at 90° to 95° C. The cooled reaction mixture was boiled up with water, hot filtered and the solid product left boiled with ethanol followed by filtration, said procedure being carried out twice more. Thereupon the solid residue was boiled with chloroform followed by filtration, said procedure being repeated twice, whereupon the solid product left was dried and represented 14 g of purified 1,3,5-tris(4-nitrophenyl) benzene.

11 g of said product was then heated with 53 g of tin granules and 25 ml of ethanol and 200 ml of concentrated hydrochloric acid were added dropwise. 5 to 6 hours heating under reflux with rapid stirring produced a tin double salt which precipitated upon cooling. This salt was dissolved in 200 ml of water, filtered and then added slowly to 200 ml of hot 30% sodium hydroxide solution, whereupon 1,3,5-tris(4-aminophenyl) benzene flocculated out. Filtration and drying yielded 8 g of 1,3,5-tris(4-aminophenyl) benzene.

This 8 g of 1,3,5-tris(4-aminophenyl) benzene together with 45 g of bromoethane and 5 g of sodium carbonate were added to 300 ml of acetone and boiled with reflux for 3 to 4 days. The reaction mixture was then cooled and filtered. The filtrate was then evaporated to dryness and dissolved in dilute hydrochloric acid followed by adding the solution slowly to 200 ml of hot 30% sodium hydroxide solution. The resulting precipitate was filtered off and dried in a drying cupboard. The obtained product was further purified over a rapid silica gel column with an eluent consisting of 95 vol % toluene and 5 vol % tetrahydrofuran. The first fraction was then further purified on a silica gel column with a toluene/ethylacetate eluent with a 0 to 2 % gradient of ethyl acetate. The thus purified product was the desired 1,3,5-tris(4(4-N,N-diethylaminophenyl) benzene with melting point: 207° to 209° C.

PREPARATION OF COMPOUND 2

1,3,5-tris(3-N,N-diethylaminophenyl) benzene was prepared from 3-nitro-acetophenone using the same synthesis procedure as described above for compound 1.

Melting point of the purified product: 157° to 158° C.

PREPARATION OF COMPOUND 7

1,3,5-tris(4-aminophenyl)benzene were prepared as described above in the preparation of compound 1. 5 g of 1,3,5-tris(4-amino-phenyl)benzene were dissolved in 150 ml of dimethyl acetamide and the solution added to a boiling mixture of 54.3 g of benzylchloride and diisopropylethylamine. The resulting mixture was refluxed for 5 hours at 140° C. with continuous stirring and then after cooling water was added until no further precipitation was observed. The precipitate was filtered off, washed with a large quantity of water and dried to yield a yellow product. This was then dissolved in a large quantity of toluene, the resulting solution heated with activated carbon and the activated carbon filtered off. The filtrate was evaporated to dryness and the residue recrystallized from a small quantity of toluene and then further purified by recrystallization from a 1:1 mixture of dichloromethane and n-hexane. The resulting 1,3,5-tris(4-N,N-dibenzylaminophenyl)-benzene had a melting point of 198° C.

PREPARATION OF COMPOUND 9

1,3,5-tris(4-aminophenyl)benzene was prepared as described above in the preparation of compound 1. 10 g of 1,3,5-tris(4-aminophenyl)benzene was mixed with 150 ml of toluene and then 0.4 g of p-toluene sulphonic acid and 13.6 g of benzaldehyde were added at room temperature. The resulting mixture was then refluxed for 3 hours and the water formed (ca. 1.5 ml) distilled off azeotropically. The resulting mixture was evaporated to dryness and the solid residue recrystallized from acetonitrile. The yellow product, 1,3,5-tris(4-benzyliminophenyl)benzene was filtered off, washed and dried and had a melting point of 99.5° to 103.5° C.

11 g of 1,3,5-tris(4-benzyliminophenyl)benzene was then dissolved in 100 ml of TMF and 25 ml of methanol added. The mixture was then heated to 40° C. and 3,4 g of sodiumborohydride was added in small quantities. On completion of the addition of sodium borohydride the temperature was increased to 60° C. and the mixture heated at this temperature for 3 hours. The reaction mixture was then filtered hot and the filtrate neutralized with 20 ml of acetic acid and diluted with water, whereupon an oil separated. The resulting mixture was then extracted with dichloromethane and the resulting solution evaporated to dryness leaving an oily residue. After adding $CCl_4$, the product was placed in a deep freeze and the product had solidified after 4 hours in the deep freeze. This was then recrystallized from a 1:1 mixture of dichloromethane and n-hexane. Filtration and drying in a vacuum drying cupboard at 50° C. produced a dirty white product which was 1,3,5(4-benzylaminophenyl)-benzene and had a melting point of 75.4 to 77.4° C.

9 g of 1,3,5-tris(4-benzylaminophenyl)benzene was then dissolved in 100 ml of DMF and the solution added dropwise to a boiling mixture of 14 g of bromo-ethane and 29 g of diisopropylethylamine. The resulting mixture was then refluxed for 22 hours. After cooling, a slight precipitate formed which was filtered off. Water was added to the filtrate until no further precipitation was observed. The precipitate was then filtered off and further purified by recrystallization from diethylether in which it is poorly soluble. The product was vacuum dried, first purified by dissolving it in dichloromethane and precipitating it with methanol and the precipitate washed with methanol. Further purification by preparative column chromatography with dichloromethane as eluent yielded 1,3,5-tris(4-benzylethylamino-phenyl)-benzene as a white product with a melting point of 105° C.

PREPARATION OF COMPOUND 11

1,3,5-tris(4-aminophenyl)benzene was prepared as described above in the preparation of compound 1. A mixture of 3 g of 1,3,5-tris(4-aminophenyl)-benzene, 22.2 g of m-iodotoluene, 5.9 g of potassium carbonate, 0.2 g of 18-crown-6 crown ether, 2.2 g of copper bronze and 40 ml of orthodichlorobenzene was flushed with argon and then the whole apparatus placed under vacuum. The mixture was then refluxed under argon for 120 hours. The reaction mixture was then filtered hot and the filtrate evaporated to dryness. High boiling point petroleum ether was then added and the product crystallized slowly in a deep freeze. It was then filtered off, dissolved in dichloromethane, precipitated with methanol and the precipitate, after drying, purified by preparative chromatographically using a 7:1 mixture of dichloromethane and n-hexane as the eluent. The 1,3,5-tris-(4-di-m -tolylaminophenyl)benzene produced had a melting point of 269.6° C.

For the production of a recording material according to the present invention at least one 1,3,5-tris(aminophenyl) benzene compound according to general formula (I) is applied in combination with a resin binder to form a charge transporting layer adhering directly to a charge generating layer on an electrically conductive support. Through the resin binder the charge transporting layer obtains sufficient mechanical strength and obtains or retains sufficient capacity to hold an electrostatic charge for copying purposes. Preferably the specific resistivity of the charge transporting layer is not lower than $10^9$ ohm.cm. The resin binders are selected on the basis of optimal mechanical strength, adhesion to the charge generating layer and favourable electrical properties.

Suitable electronically inactive binder resins for use in the charge transporting layer are e.g. cellulose esters, acrylate and methacrylate resins, cyanoacrylate resins, polyvinyl chloride, copolymers of vinyl chloride, e.g. a copolymer of vinyl chloride with vinyl acetate and maleic anhydride, polyester resins, e.g. copolyesters of isophthalic acid and terephthalic acid with glycol or aromatic polycarbonate resins.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nourvertnéin the Encyclopedia of Polymer Science and Engineering, 2nd ed., Vol. II, pages 648–718, (1988) published by Wiley and Sons Inc., and have one or more repeating units within the scope of the following general formula (II):

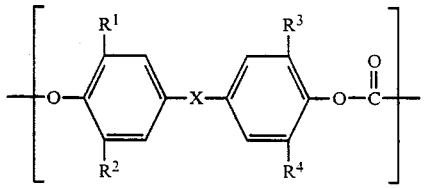

(II)

wherein:

X represents S, $SO_2$,

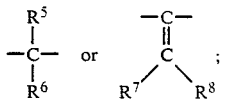

$R^1$, $R^2$, $R^3$, $R^4$, $R^7$ and $R^8$ represents (same or different) hydrogen, halogen, an alkyl group or an aryl group, and $R^5$ and $R^6$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10,000 to 200,000 are preferred. Suitable polycarbonates having such a high molecular weight are sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R^1=R^2=R^3=R^4=H$, X is $R^5—C—R^6$ with $R^5=R^6=CH_3$.

MAKROLON 5700 (registered trade mark) is a bisphenol A polycarbonate with molecular weight in the range of 50,000 to 120,000 wherein $R^1=R^2=R^3=R^4=H$, X is $R^5—C—R^6$ with $R^5=R^6=CH_3$.

Bisphenol Z polycarbonate is an aromatic polycarbonate containing recurring units wherein $R^1=R^2=R^3=R^4=H$, X is $R^5—C—R^6$, and $R^5$ together with $R^6$ represents the necessary atoms to close a cyclohexane ring.

Further useful binder resins are silicone resins, polystyrene and copolymers of styrene and maleic anhydride and copolymers of butadiene and styrene.

An example of an electronically active resin binder is poly-N-vinylcarbazole or copolymers of N-vinylcarbazole having a N-vinylcarbazole content of at least 40 % by weight.

The ratio wherein the charge-transporting compound and the resin binder are mixed can vary. However, relatively specific limits are imposed, e.g. to avoid crystallization. The content of the 1,3,5-tris(aminophenyl) benzene used according to the present invention in a positive charge transport layer is preferably in the range of 30 to 70% by weight with respect to the total weight of said layer. The thickness of the charge transport layer is in the range of 5 to 50 μm, preferably in the range of 5 to 30 μm.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-acceptor groups forming an intermolecular charge transfer complex, i.e. donor-acceptor complex wherein the 1,3,5-tris(aminophenyl) benzene represents a donor compound by the presence of its electron donating amino groups. Useful compounds having electron-accepting groups are nitrocellulose and aromatic nitro-compounds such as nitrated fluorenone-9 derivatives, nitrated 9-dicyanomethylenefluorenone derivatives, nitrated naphthalenes and nitrated naphthalic acid anhydrides or imide derivatives. The optimum concentration range of said derivatives is such that the molar donor/acceptor ratio is 10:1 to 1,000:1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

The charge transport layer used in the recording material according to the present invention possesses the property of offering a high charge transport capacity coupled with a low dark discharge.

While with the common single layer photoconductive systems an increase in photosensitivity is coupled with an increase in the dark current and fatigue such is not the case in the double layer arrangement wherein the functions of charge generation and charge transport are separated and a photosensitive charge generating layer is arranged in contiguous relationship to a charge transporting layer.

As charge generating compounds for use in a recording material according to the present invention any of the organic pigment dyes belonging to one of the classes (a) to (n) mentioned hereinbefore may be used. Further examples of pigment dyes useful for photogenerating positive charge carriers are disclosed in U.S. Pat. No. 4,365,014.

Inorganic substances suited for photogenerating positive charge carriers are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

Said photoconductive substances functioning as charge generating compounds may be applied to a support with or without a binding agent. For example, they are coated by vacuum-deposition without binder as described e.g. in U.S. Pat. No. 3,972,717 and 3,973,959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. The binding agent(s) may be the same as the one(s) used in the charge transport layer which normally provides best adhering contact. In some cases it may be advantageous to use in one or both of said layers a plasticizing agent, e.g. halogenated paraffin, polybiphenyl chloride, dimethylnaphthalene or dibutyl phthalate.

The thickness of the charge producing layer is preferably not more than 5 μm, more preferably not more than 2 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall negatively electrostatically charging, e.g. with corona-device, the charge transporting layer or charge generating layer of the recording material of the present invention.

(2) image-wise photo-exposing the charge generating layer of said recording material thereby obtaining a latent electrostatic image.

The photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the by photo-exposure discharged areas obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, N.Y., enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof. For light in the spectral range beyond 800 nm e.g. naphthalocyanines having siloxy groups bonded to the central metal silicon can be used as charge generating substance (ref. published EP-A 0 243 205).

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out as follows:

The photoconductive recording sheet material was mounted with its conductive backing on an aluminium drum which was earthed and rotated at a circumferential speed of 10 cm/s. The recording material was sequentially charged with a negative corona at a voltage of −4.6 kV operating with a corona current of about 1 μA per cm of corona wire. Subsequently the recording material was exposed (simulating image-wise exposure) with a light dose corresponding to 13.2 mJ/m2 of 650 mm light obtained from a monochromator positioned at the circumference of the drum at an angle of 45° with respect to the corona source. The photo-exposure lasted 200 ms. Thereupon, the exposed recording material passed an electrometer probe positioned at an angle of 180° with respect to the corona source.

After effecting an overall post-exposure with a halogen lamp producing 27.000 mJ/m2 positioned at an angle of 270° with respect to the corona source a new copying cycle started.

Each measurement relates to 100 copying cycles in which 10 cycles without 650 nm light exposure are alternated with 5 cycles with 650 nm light exposure.

The charging level (CL) is taken as the average charging level over the 90th to 100th cycle, the residual potential (RP) as the residual potential over the 85th to 90th cycle, the % discharge as $(CL-RP)/Cl\times 100$ and the fatigue (F) as the difference in residual potential in volts between RP and the average residual potential over the 10th to 15th cycle.

For a given corona voltage, corona current, separating distance of the corona wires to recording surface and drum circumferential speed the charging level CL is only dependent upon the thickness of the charge transport layer and its specific resistivity. In practice CL expressed in volts should be preferably $\geqq 30$ d, where d is the thickness in μm of the charge transport layer.

Under the applied exposure conditions, simulating practical copying conditions, and by using a charge transport layer in conjunction with a charge generating layer on the basis of X-phthalocyanine as the charge generating pigment, the % discharge should be at least 35 % and preferably at least 50 %. The fatigue F should preferably not exceed 20 V either negative or positive to maintain a uniform image quality over a large number of copying cycles.

All ratios and percentages mentioned in the Examples are by weight.

EXAMPLE 1

A photoconductor sheet was produced by coating a 100 μm thick polyester film being vapour-coated with a conductive layer of aluminium with a dispersion of charge generating pigment to a thickness of 0.5 μm with a doctor-blade coater.

Said dispersion was prepared by mixing for 20 minutes in a pearl mill 1 g of metal free purified X-phthalocyanine, 0.1 g of DYNAPOL L 206 (registered trade mark), 0.9 g of bisphenol Z polycarbonate and 23 g of dichloromethane which dispersion was then diluted with 8.33 g of dichloromethane before coating to adjust the viscosity for coating.

The applied dispersion layer was dried for 15 minutes at 80° C. and then overcoated using a doctor-blade coater to a thickness of 10 μm with a filtered solution of charge transporting layer coating composition consisting of 2 g of 1,3,5-tris(4-N,N-diethylaminophenyl) benzene (number 1 in the Table), 2 g of bisphenol Z polycarbonate and 21 g of tetrahydrofuran. This layer was then dried for 1 h at 80° C.

The performance characteristics of the thus obtained photoconductive recording material were determined as described above with the following results:

CL = −735 V.
RP = −339 V.
% discharge = 53.9%.
F = +12 V.

EXAMPLE 2

A photoconductor sheet was produced as described in Example 1 except that the charge transporting layer consisted of 50% of 1,3,5-tris(3-N,N-diethylaminophenyl) benzene (number 2 in the Table) in bisphenol Z polycarbonate. The performance characteristics of the thus prepared photoconductive recording material were determined as described above with the following results:

CL = −733 V.
RP = −475 V.
% discharge = 35.2%.
F = +98 V.

EXAMPLE 3

A photoconductor sheet was produced as described in Example 1 except that the charge generating pigment in the charge generating layer was 4,10-dibromoanthanthrone and bisphenol A polycarbonate was used as the binder instead of bisphenol Z polycarbonate. The performance characteristics of said photoconductive sheet were determined as described above except that it was exposed with 19.0 mJ/m2 of 540 nm light instead of 13.2 mJ/m2 of 650 nm light. The following results were obtained:

CL = −862 V.
RP = −210 V.
% discharge = 75.6%.
F = +31 V.

EXAMPLE 4

A photoconductor sheet was produced as described in Example 1 except that bisphenol A polycarbonate MAKROLON CD 2000 (registered trade mark) was used instead of bisphenol Z polycarbonate in the charge generating layer and that the charge transporting layer consisted of 30% of substance 7 in the Table and 70% of the bisphenol A polycarbonate MAKROLON CD 2000 (registered trade mark). The performance characteristics of the thus prepared photoconductive recording material were determined as described above with the following results:

CL=−879 V.
RP=−454 V.
% discharge=48.3.
F=−21 V.

EXAMPLE 5

A photoconductor sheet was produced as described in Example 4 except that the charging transporting layer consisted of 50% of substance 9 in the Table and 50% of the bisphenol A polycarbonate MAKROLON CD 2000 (registered trade mark). The performance characteristics of the thus prepared photoconductive recording material were determined as described above with the following results:

CL=−833 V.
RP=−415 V.
% discharge=50.2.
F=−37 V.

EXAMPLE 6

A photoconductor sheet was produced as described in Example 5 except that the charge generating pigment in the charge generating layer was 4,10-dibromoanthanthrone instead of metal-free X-phthalocyanine. The performance characteristics of the thus prepared photoconductive recording material were determined as described above except that it was exposed with 6.0 mJ/m2 of 540 nm light instead of 13.2 mJ/m2 of 650 nm light. The following results were obtained:

CL=−910 V.
RP=−584 V.
% discharge=35.8.
F=−46 V.

EXAMPLE 7

A photoconductor sheet was produced as described in Example 5 except that the charge transporting compound in the charge transporting layer was substance 13 in the Table instead of substance 9. The performance characteristics of the thus prepared photoconductive recording material were determined as described above with the following results:

CL=−489 V.
RP=−151 V.
% discharge=69.1.
F=+39 V.

EXAMPLE 8

A photoconductor sheet was produced as described in Example 7 except that the charge generating pigment in the charge generating layer was 4,10-dibromoanthanthrone instead of metal-free X-phthalocyanine. The performance characteristics of the thus prepared photoconductive recording material were determined as described above except that it was exposed with 6.0 mJ/m2 of 540 nm light instead of 13.2 mJ/m2 of 650 nm light. The following results were obtained:

CL=−685 V.
RP=−494 V.
% discharge=27.9.
F=−14 V.

EXAMPLE 9

A photoconductor sheet was produced as described in Example 5 except that the charge transporting compound in the charge transporting layer was substance 8 in the Table instead of substance 9. The performance characteristics of the thus prepared photoconductive recording material were determined as described above with the following results:

CL=−800 V.
RP=−670 V.
% discharge=16.2.
F=−146 V.

EXAMPLE 10

A photoconductor sheet was produced as described in Example 5 except that the charge transporting layer consisted of 40% of substance 10 in the Table and 60% of the bisphenol A polycarbonate MAKROLON CD 2000 (registered trade mark) instead of 50% of substance 9 in the Table and 50% of MAKROLON CD 2000 (registered trade mark). The performance characteristics of the thus prepared photoconductive recording material were determined as described above with the following results:

CL=−790 V.
RP=−585 V.
% discharge=25.9.
F=−100 V.

EXAMPLE 11

A photoconductor sheet was produced as described in Example 5 except that the charge transporting compound in the charge transporting layer was substance 15 in the Table instead of substance 9. The performance characteristics of the thus prepared photoconductive recording material were determined as described above with the following results:

CL=−727 V.
RP=−392 V.
% discharge=46.1.
F=−63 V.

EXAMPLE 12

A photoconductor sheet was produced as described in Example 11 except that the charge generating pigment in the charge generating pigment layer was 4,10-dibromoanthanthrone instead of metal-free X-phthalocyanine. The performance characteristics of the thus prepared photoconductive recording material were determined as described above except that it was exposed with 6.0 mJ/m2 of 540 nm light instead of 13.2 mJ/m2 of 650 nm light. The following results were obtained:

CL=−790 V.
RP=−412 V.
% discharge=47.8.
F=−92 V.

We claim:

1. An electrophotographic recording material comprising a conductive support and a photosensitive layer containing a photoconductive compound that has p-type charge transport capacity and corresponds to the following general formula (I):

(I)

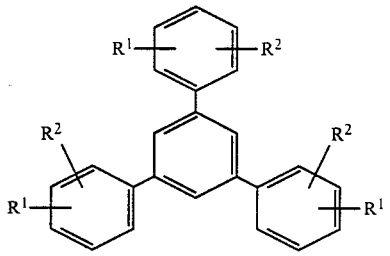

wherein:

$R^1$ represents a $—NR^3R^4$ group, wherein each of $R^3$ and $R^4$ (same or different) represents a $C_1$–$C_{10}$ alkyl group, a cycloalkyl group, or an aryl group, and $R^2$ represents hydrogen, an alkyl group or halogen.

2. An electrophotographic recording material according to claim 1, wherein said material comprises a charge generating layer in contiguous relationship with a charge transporting layer, and said charge transporting layer contains said photoconductive compound according to said general formula (I).

3. An electrophotographic recording material according to claim 1, wherein $R^2$ represents methyl, ethyl or an ethoxycarbonyl substituted alkyl group.

4. An electrophotographic recording material according to claim 1, wherein each of $R^3$ and $R^4$ (same or different) represents benzyl or alkoxycarbonyl substituted alkyl.

5. An electrophotographic recording material according to claim 1, wherein the compound according to general formula (I) has a melting point of at least 100° C.

6. An electrophotographic recording material according to claim 2, wherein a compound according to general formula (I) is applied in combination with a resin binder to form a charge transporting layer adhering directly to said positive charge generating layer being itself carried by an electrically conductive support.

7. An electrophotographic recording material according to claim 6, wherein the resin binder or binders is (are) selected from the group consisting of a cellulose ester, acrylate and methacrylate resins, polyvinyl chloride, copolymers of vinyl chloride, polyester resins, aromatic polycarbonate resins, silicone resins, polystyrene and copolymers of styrene and maleic anhydride, copolymers of butadiene and styrene, poly-N-vinylcarbazole and copolymers of N-vinylcarbazole having a N-vinylcarbazole content of at least 40% by weight.

8. An electrophotographic recording material according to claim 2, wherein the content of said compound according to general formula (I) in the charge transporting layer is in the range of 30 to 70 by weight with respect to the total weight of said layer.

9. An electrophotographic recording material according to claim 8, wherein the thickness of said charge transporting layer is in the range of 5 to 50 μm.

10. An electrophotographic recording material according to claim 2, wherein the positive charge generating layer contains for photo-induced electron-positive hole pair formation an organic substance selected from the group consisting of:

(a) perylimides,
(b) polynuclear quinones,
(c) quinacridones,
(d) naphthalene 1,4,5,8 tetracarboxylic acid derived pigments,
(e) phthalocyanines,
(g) benzothioxanthene-derivatives,
(h) perylene 3,4,9,10-tetracarboxylic acid derived pigments,
(i) polyazo pigments, and
(j) squarilium dyes.
(k) polymethine dyes.
(l) dyes containing quinazoline groups,
(m) triarylmethane dyes, and
(n) dyes containing 1,5-diamino-anthraquinone groups.

11. An electrophotographic recording material according to claim 1, wherein the conductive support is made of aluminum, steel, brass or paper or resin material incorporating or being coated with a conductivity enhancing substance, the support being in the form of a foil, web or being part of a drum.

* * * * *